United States Patent [19]

Tran

[11] 3,953,758

[45] Apr. 27, 1976

[54] MULTIPERIODIC LINEAR ACCELERATING STRUCTURE

[75] Inventor: Duc Tien Tran, Paris, France

[73] Assignee: C.G.R.-Mev., Paris, France

[22] Filed: Jan. 14, 1975

[21] Appl. No.: 540,942

[30] Foreign Application Priority Data

Jan. 15, 1974 France ..... 74.01284

[52] U.S. Cl. ..... 313/360; 315/5.41; 328/233

[51] Int. Cl.[2] ..... H01J 23/20

[58] Field of Search ..... 328/233; 313/360; 315/5.41

[56] References Cited

UNITED STATES PATENTS

| | | | |
|---|---|---|---|
| 3,068,425 | 12/1962 | Le Boutet et al. | 328/233 X |
| 3,546,524 | 12/1970 | Stark | 328/233 X |
| 3,611,166 | 10/1971 | Epsztein | 328/233 |
| 3,796,906 | 3/1974 | Henry-Bezy et al. | 315/5.41 |

*Primary Examiner*—Palmer C. Demeo

*Attorney, Agent, or Firm*—Cushman, Darby & Cushman

[57] ABSTRACT

Multiperiodic linear accelerating structures comprising a succession of cylindrical accelerating cavities $C_a$ having a revolution axis $X_1$ $X_2$, and being coupled to each other by cylindrical coupling cavities $C_c$ having the axis $X_1$ $X_2$ as revolution axis, which coincides with the mean path of the beam of the particles to be accelerated, the radius $R_c$ of the coupling cavities $C_c$ being substantially equal to the radius $R_a$ of the accelerating cavities $C_a$. Accelerating and coupling cavities are constituted by a stack of elements easy to machine and braze together.

9 Claims, 4 Drawing Figures

MULTIPERIODIC LINEAR ACCELERATING STRUCTURE

The present invention relates to multiperiodic linear accelerating structures comprising a succession of accelerating cavities which are coupled to each other by orifices or coupling cavities. These coupling cavities may be disposed on the periphery of the accelerating cavities, or for smaller overall size, between these accelerating cavities. These coupling cavities are more specifically the subject of the present invention.

According to the invention there is provided a multiperiodic linear accelerating structure for accelerating a beam of charged particles, along an an axis $X_1X_2$, by means of the action of an electromagnetic energy injected within said structure, said structure comprising a succession of accelerating resonant cavities of cylindrical shape and having the axis $X_1$ $X_2$ as revolution axis and coupling means for coupling two consecutive accelerating cavities, said coupling means comprising at least coupling cavities of cylindrical shape and having an axis $X_1X_2$ as axis of revolution, each coupling cavity being disposed between two accelerating cavities, the radius of said coupling cavities being substantially equal to the radius of the accelerating cavities and the width of the coupling cavities, measured in the direction parallel to the axis $X_1$ $X_2$, being greater in the axial region, where the electrical component of the electromagnetic field produced by said electromagnetic energy is preponderant, than in the peripheral region.

For a better understanding of the invention and to show how the same may be carried into effect, reference will be made to the drawings accompanying the ensuing description in which.

Figure 1:
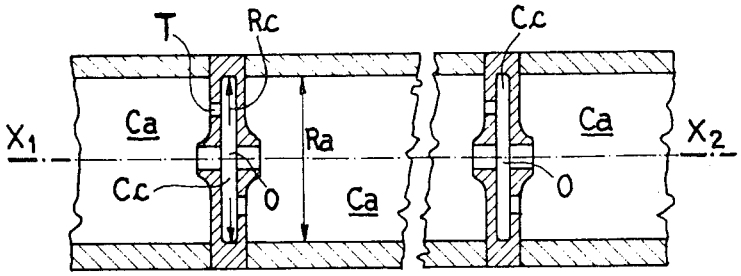
FIG. 1 is a diagrammatic view of an accelerating structure according to the invention.

The accelerating structure according to the invention shown in FIG. 1 comprises a succession of cylindrical accelerating cavities $C_a$ of axis $X_1$ $X_2$ and coupling cavities $C_c$ for coupling two consecutive accelerating cavities $C_a$. These coupling cavities $C_c$ have a radius $R_c$ which is substantially equal to the radius $R_a$ of the accelerating cavities $C_a$ and are provided, in their centre, with an opening O for the passage of the beam of charged particles and, outside the central zone, with orifices T for coupling the coupling cavities $C_c$ with the accelerating cavities $C_a$ associated therewith.

To obtain a linear accelerating structure having a good efficiency per unit length, the coupling cavities $C_c$ must be as narrow as possible. But the narrower these coupling cavities $C_c$ the greater the increase in the inductance due to the coupling holes and therefore the smaller must be their radius $R_c$ to obtain the suitable resonant frequency. In the accelerating structure according to the invention, the radius $R_a$ of the accelerating cavities $C_a$ and $R_c$ of the coupling cavities $C_c$ are equal, and this enables there accelerating structures to be constructed easily and with high precision, the excessive value of the inductance due to the coupling holes of the coupling cavities $C_c$ being compensated for by an increase in the width of the coupling cavities $C_c$, in the axial region.

Figure 2:
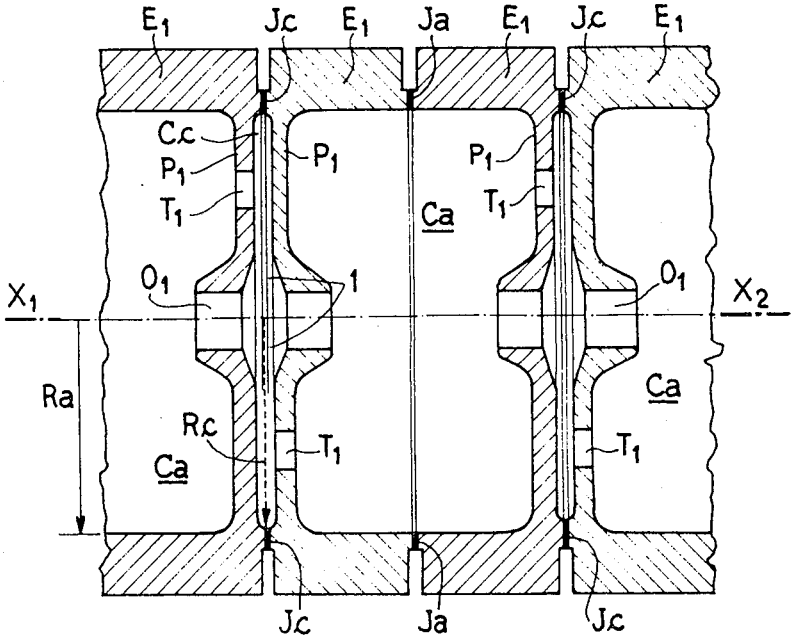
FIGS. 2 and 3 are sectional views of two embodiments of a biperiodic accelerating structure according to the invention.

FIG. 2 shows an embodiment of a biperiodic accelerating structure according to the invention. This structure comprises a stack of elements $E_1$ of cylindrical shape and axis $X_1X_2$, the elements $E_1$ having at one of their ends a circular wall $P_1$ perpendicular to the axis $X_1X_2$. These walls $P_1$ are placed in facing relation to each other and have such shape that they define therebetween, after assembly, a coupling cavity $C_c$ of cylindrical shape and axis $X_1X_2$. The central part of these walls is thickened and provided with an axial opening $O_1$ allowing the passage of the beam of particles to be accelerated and the orifice $T_1$ located outside the axis and permitting the coupling of the coupling cavity $C_c$ and two accelerating cavities $C_a$ associated therewith. The orifices $T_1$ opening into two successive accelerating cavities $C_a$ are preferably located at 180° to each other, as shown in FIG. 2.

The elements $E_1$ are assembled by means of brazed joints $J_a$ and $J_c$.

Figure 3:
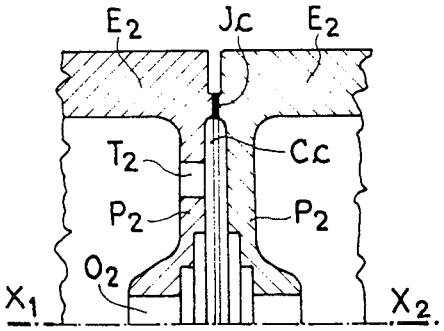

The increase in the width of the coupling cavities in their central region is uniform in the embodiment shown in FIG. 2. Another embodiment of a biperiodic accelerating structure according to the invention is shown in FIG. 3. It is constituted by a stack of cylindrical elements $E_2$ having at one of their ends a circular wall $P_2$ provided with a central opening $O_2$ and an orifice $T_2$ outside the axis. The width of the central region of the coupling cavities $C_c$ increases in a non-uniform manner.

Figure 4:
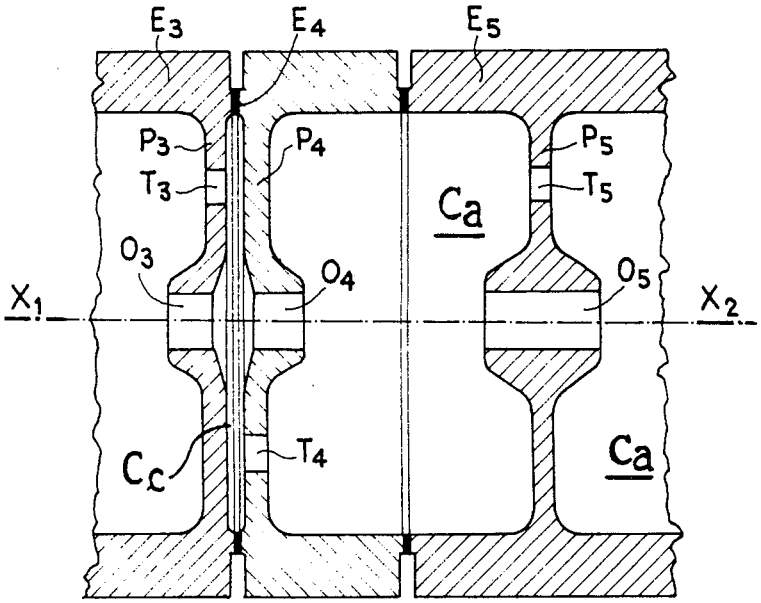
FIG. 4 is a view of a triperiodic accelerating structure according to the invention.

FIG. 4 shows an embodiment of a triperiodic accelerating structure which is constituted by a stack of groups of cylindrical elements $E_3$, $E_4$, $E_5$. The elements $E_3$ and $E_4$ are identical and comprise respectively, at one of their ends, the circular walls $P_3$ and $P_4$ which are placed in facing relation to each other. The shape of the walls $P_3$ and $P_4$ is such that they define therebetween, when the elements $E_3$ and $E_4$ are assembled, a cylindrical coupling cavity $C_c$ which widens in the axial region. The walls $P_3$ and $P_4$ are respectively provided with central openings $O_3$ and $O_4$ and coupling holes $T_3$ and $T_4$. The cylindrical element $E_5$ has, in its middle, a circular wall $P_5$ perpendicular to the axis $X_1$ $X_2$ are provided with a central opening $O_5$ and a coupling hole $T_5$ located outside the axis $X_1X_2$. The rather thin walls $P_3$, $P_4$ and $P_5$ are thickened in the central region as shown in FIG. 4.

Such accelerating structures constituted by a stack of elements easy to machine and braze together are simple to construct and precise.

What I claim is:

1. A multiperiodic linear accelerating structure for accelerating a beam of charged particles along an axis $X_1X_2$ by means of the action of an electromagnetic energy injected within said structure, said structure, comprising a succession of accelerating resonant cavities of a cylindrical shape and having said axis $X_1X_2$ as revolution axis, and coupling means for coupling two consecutive accelerating cavities, said coupling means comprising at least coupling cavities $C_c$, of cylindrical shape having the axis $X_1X_2$ as axis of revolution, each coupling cavity $C_c$, being disposed between two accelerating cavities $C_a$, the radius $R_c$ of said coupling cavities being substantially equal to the radius $R_a$ of the accelerating cavities and the width of the coupling cavities, measured in a direction parallel to the axis $X_1X_2$, being greater in the axial region, where the electrical component of the electromagnetic field produced by said electromagnetic energy is preponderant, than in the peripheral region.

2. An accelerating structure as claimed in claim 1, wherein said structure is biperiodic.

3. An accelerating structure as claimed in claim 2, wherein said structure is constituted by a stack of cylindrical elements $E_1$, respectively comprising, at one of their ends, a circular wall $P_1$, perpendicular to said axis $X_1X_2$, the walls $P_1$, of two consecutive elements $E_1$, being disposed in pairs in facing relation to each other and having such shape that they define therebetween, after assembly, a coupling cavity $C_c$, of cylindrical shape and said walls $P_1$ being provided with a central opening $O_1$, for the passage of said beam, and orifices $T_1$ located outside tha axis $X_1X_2$, for coupling cavity $C_c$ with the two accelerating cavities $C_a$ associated therewith.

4. An accelerating structure as claimed in claim 3, wherein said coupling cavities $C_c$ have, in the axial region, a width increases in a uniform manner in the direction from the periphery toward the axis $X_1X_2$.

5. An accelerating structure as claimed in claim 3, wherein said coupling cavities $C_c$ have, in the axial region, a width increases in a non-uniform manner in the direction from the periphery toward the axis $X_1X_2$.

6. An accelerating structure as claimed in claim 1, wherein said structure is triperiodic.

7. An accelerating structure as claimed in claim 6, wherein said structure is constituted by a stack of groups of elements $E_3$, $E_4$, $E_5$ of cylindrical shape, the elements $E_3$ and $E_4$ being identical and comprising respectively, at one of their ends, a circular wall $P_3$ and a circular wall $P_4$ which are perpendicular to the axis $X_1X_2$, said identical wall $P_3$ and $P_4$ being disposed in facing relation to each other and having such shape that they define therebetween, after assembly, a coupling cavity $C_c$ of cylindrical shape, the element $E_5$ comprising in its middle a circular wall $P_5$ perpendicular to the axis $X_1X_2$, said walls $P_3$, $P_4$, $P_5$ being provided in their center, respectively with openings $O_3$, $O_4$, $O_5$ for the passage of said beam, said walls $P_3$ and $P_4$ being provided respectively, outside the axial region, with coupling holes $T_3$ and $T_4$ for coupling each coupling cavity $C_c$ with the two accelerating cavities $C_a$ associated therewith, and said wall $P_5$ being provided, outside the axial region, with a hole $T_5$ for directly coupling the two accelerating cavities $C_a$ located on each side of said wall $P_5$.

8. An accelerating structure as claimed in claim 6, wherein said coupling cavities $C_c$ have, in the axial region, a width increases in a uniform manner in the direction from the periphery toward the axis $X_1X_2$.

9. An accelerating structure as claimed in claim 6, wherein said coupling cavities have, in the axial region, a width which increases in a non-uniform manner in the direction from the periphery toward the axis $X_1X_2$.

* * * * *